US007805861B2

(12) United States Patent
Guerrier

(10) Patent No.: US 7,805,861 B2
(45) Date of Patent: Oct. 5, 2010

(54) SNOW REMOVAL APPARATUS AND METHOD OF DOING THE SAME

(76) Inventor: Walker Guerrier, 1286 Grand Ave., Baldwin, NY (US) 11510

( * ) Notice: Subject to any disclaimer, the term of this patent is extended or adjusted under 35 U.S.C. 154(b) by 0 days.

(21) Appl. No.: 11/600,516

(22) Filed: Nov. 16, 2006

(65) Prior Publication Data

US 2008/0115390 A1 May 22, 2008

(51) Int. Cl.
*E01H 1/00* (2006.01)

(52) U.S. Cl. ..... 37/196; 254/88; 414/569

(58) Field of Classification Search ..... 414/565, 414/566, 569, 571; 37/196, 197; 254/3 C, 254/4 C, 5 C, 88; 49/33, 131, 133, 347; 404/35; 248/690, 691, 692, 693
See application file for complete search history.

(56) References Cited

U.S. PATENT DOCUMENTS

| | | | | | |
|---|---|---|---|---|---|
| 1,085,657 | A | * | 2/1914 | Appleton | 49/263 |
| 1,181,712 | A | * | 5/1916 | Wittliff | 5/306 |
| 1,658,044 | A | * | 2/1928 | Fagan | 52/71 |
| 1,916,631 | A | | 7/1933 | Muchnic | |
| 2,473,126 | A | * | 6/1949 | Alexander | 14/71.1 |
| 2,704,502 | A | * | 3/1955 | Rainey | 454/7 |
| 3,076,390 | A | | 2/1963 | Cluster | |
| 3,411,169 | A | * | 11/1968 | Guerke | 14/71.1 |
| 3,557,670 | A | | 1/1971 | Sutton | |
| 4,253,257 | A | * | 3/1981 | Albert | 37/197 |
| 5,131,631 | A | * | 7/1992 | Cobbe | 256/17 |
| 5,595,028 | A | * | 1/1997 | Handzlik | 52/32 |
| 5,600,921 | A | * | 2/1997 | Vardaro | 49/380 |
| 5,778,604 | A | * | 7/1998 | Snow | 52/66 |
| 5,924,836 | A | * | 7/1999 | Kelly | 414/482 |
| 5,950,981 | A | * | 9/1999 | Judy | 248/693 |
| 6,007,271 | A | | 12/1999 | Cole et al. | |
| 6,065,266 | A | | 5/2000 | Behr et al. | |
| 6,155,005 | A | * | 12/2000 | McNamara | 52/169.6 |
| 2003/0235468 | A1 | | 12/2003 | Sproules | |
| 2004/0182004 | A1 | * | 9/2004 | Gowland | 49/33 |

* cited by examiner

*Primary Examiner*—Gary S Hartmann
(74) *Attorney, Agent, or Firm*—Richard B. Klar; Law Office of Richard B. Klar

(57) ABSTRACT

The invention relates to a method and an apparatus for the removal of snow from the ground. The invention includes an arrangement of plates and cables constructed and arranged to tilt a first or main plate disposed on or over a ground surface where snow removal is desired. The plates are connected to a set of cables, preferably arranged in a Y shaped configuration so that the main plate is tilted to one side by a motor driving the cable structure and lifting and tilting the main plate so that snow on the main plate slides off of the tilted main plate and into a base located on a side of the main plate. A second or mini plate is arranged preferably under the center area of the main plate and the cables are connected to the mini plate to lift and tilt the main plate to cause the snow to slide into the base.

12 Claims, 6 Drawing Sheets

SNOW REMOVAL APPARATUS AND METHOD OF DOING THE SAME

BACKGROUND OF THE INVENTION

Field of the Invention

The present invention relates to a method and an apparatus for the removal of snow from a ground surface by a plate and cable arrangement designed to lift and tilt a main plate located on a ground surface so that the snow on the main plate is deposited into a base located on a side of the main plate. In particular, the present invention provides for the removal of snow by one or more plates horizontally disposed on the ground of a surface such as a driveway, side walk or an airport runway wherein the plate has a mini-plate disposed at or near its center and cables are fastened to the main plate and mini-plate.

A base is provided on one side of the main plate that attaches to the plate by hinges that permit the plate to move in a tilting fashion but also are secured to the floor or a wall by screws or any other known fastening and anchoring means. A motor driven mechanism, separate from the base, moves the cable attachment to the main plate and mini-plate so that the side of the main plate opposite the side of the main plate where the base is attached tilts upward so that snow slides off the main plate into the base. A pull cable serves to limit the amount of tilt motion of the main plate.

The mini-plate serves to distribute the force on the cable when the plate is tilted upward as does the Y-shaped cable configuration where the base plate is tilted downward toward the ground. A second or mini plate is arranged preferably under the center area of the base plate and the cables are connected to the mini plate to lift and tilt the base plate to cause the snow to slide into the base.

BRIEF DESCRIPTION OF THE DRAWINGS

FIGS. 2A and 2B illustrates how the mini plate is placed in contact and connected to the main plate of the present invention wherein:

FIG. 2A is a top view of the main-plate and the mini-plate;

FIG. 2B is a view taken along lines 2B-2B of FIG. 2A;

DETAILED DESCRIPTION OF THE PREFERRED EMBODIMENT(S)

Figure 1:
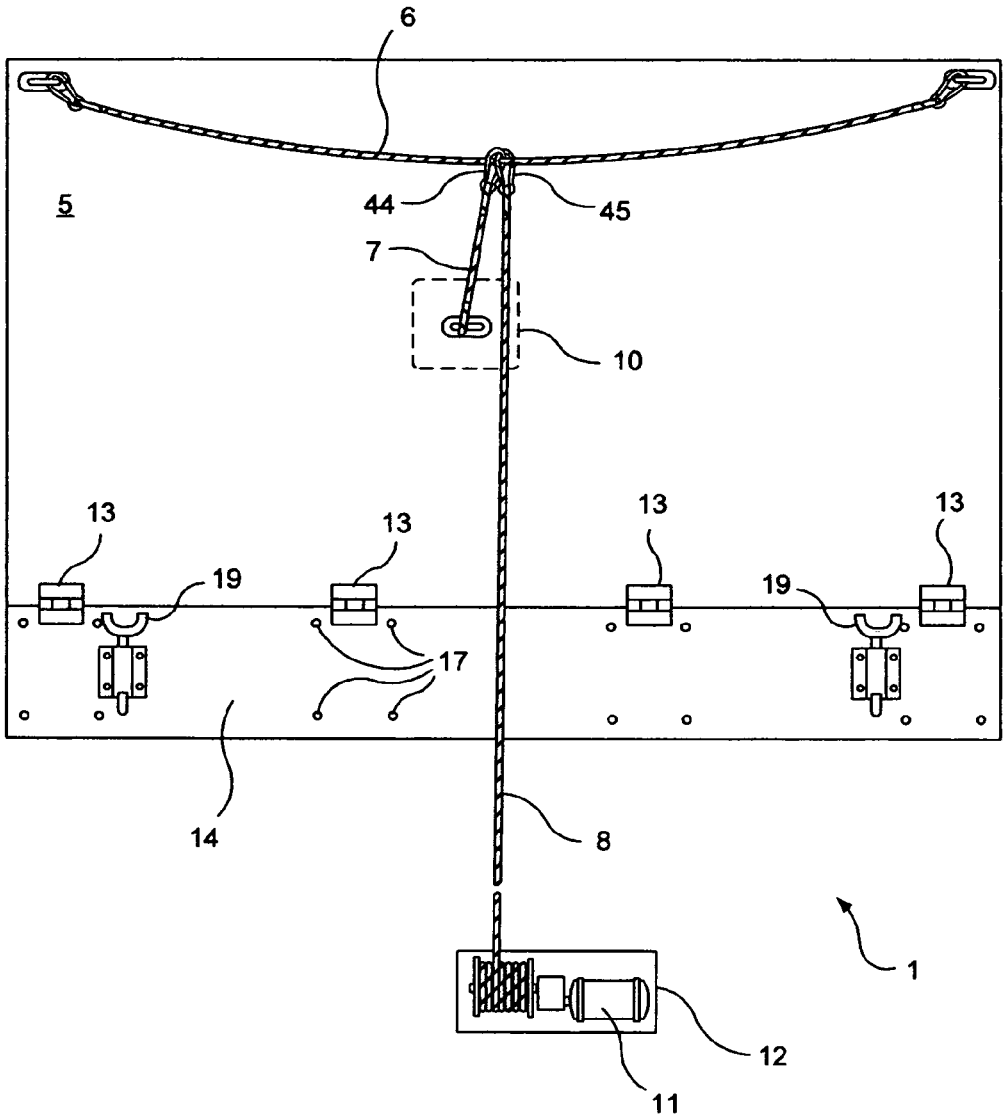
FIG. 1 is a top view of the snow removal apparatus of the present invention.
Figure 2A:
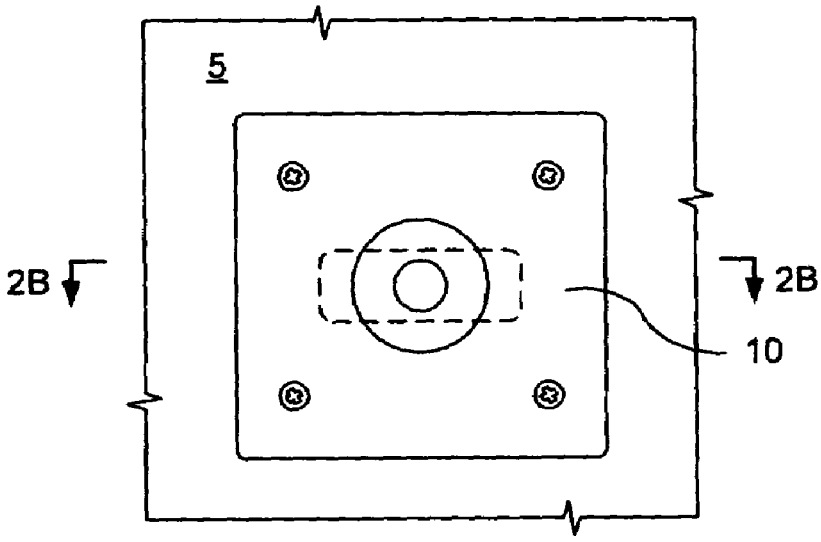
Figure 2B:
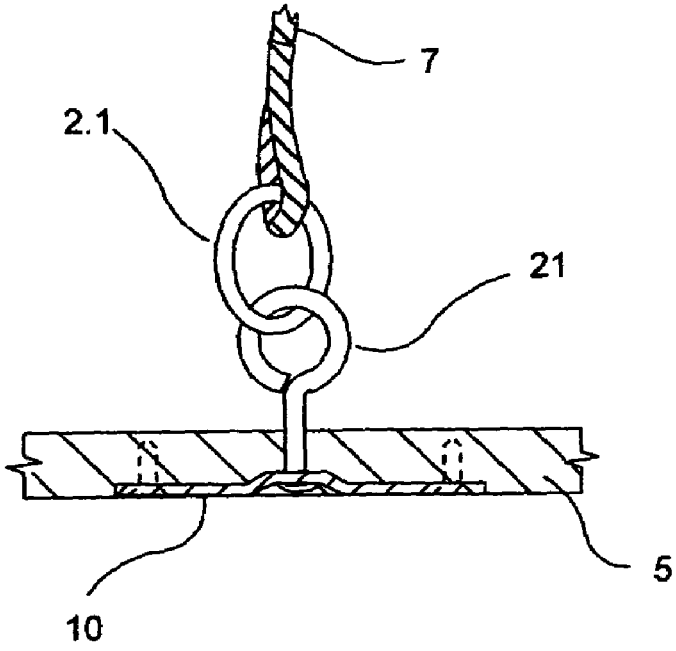

Referring now to the drawings, FIG. 1 illustrates a top view of the snow removal apparatus of the present invention. The apparatus 1 includes a first or main plate 5 and a second or mini-plate 10 disposes underneath the main plate 5 (see FIG. 2). Two cables, an upper cable and a lower cable, 6 and 7 respectively, arranged in a Y-shaped configuration serve to connect the plates to a motor 11 having a motor housing 12 for driving the cables 6 and 7 and thereby lifting and tilting the main plate upward for snow deposited thereon to slide off and onto the base 14 connected to a side of the main plate 5 by hinges 17, such as but not limited to door hinges 13. A motor driven mechanism 12, separate from the base 14, moves the cable attachment to the main plate 5 and mini-plate 10 so that the side of the main plate 5 opposite the side of the main plate 5 where the base 14 is attached tilts upward so that snow slides off of the main plate 5 and onto the base 14. A pull cable 8 serves to limit the amount of tilt motion of the main plate. The upper cable 6 has two ends each of which is secured to a corner of the two corners of the main plate 5 by quick links and ubolts. Each end of cable 5 has a looped end that is secured to a quick link which also connects to the u bolt 17 at each of the corners of the main plate as shown in FIG. 4. The loops of upper cable 5 are soldered to keep them in place after passing through the quick link. Quick links are made by Lehigh in Mauyer, Pa. in sizes of 5/16' by 2¾' as Lehigh #7442 and are sold by Home Depot. The two looped ends of cable 5 are secured to the main plate at the top two corners of the main plate by u-bolts 17 which require two holes per u-bolt 17 (see FIG. 3A). The u bolts 17 are manufactured by Lehigh as Lehigh #71231 and are sold by Home Depot and Sears. The mini-plate 10 is secured to the main plate at the center by four screws (see FIG. 2). The middle area of the upper cable 6 five passes through another quick link. 44. This quick link 44 also passes through the hitching mini plate quick link 45 attached to the lower cable 7. The puller cable 8 has a loop that passes through the quick link 44 at one end and is connected at the other end to the motor 12.

The middle portion of the upper cable 6 passes through the two quick links 44 and 45. Quick link 44 is attached also attached to one end of the cable of the mini plate 10 e.g. the lower cable (see FIGS. 3 and 8). Quick link 45 is also attached to one end of the puller cable 8. The other end of the puller cable 8 is connected to the motor 12. Quick links 44 and 45 are also connected to each other. This linkage between the quick links 44 and 45 eases the strain on the motor 12 during the pulling process and more safely secures the cables to the mini plate 10.

The main plate 5 can be made of plywood or any suitable substitute therefore.

The mini plate 10 is commercially available with and with the ring already attached and sold by Home Depot as a hinged ring mini-plate. (see FIG. 2). The mini-plate can also be custom designed and made to vary in size to proportionately for different sized main plates. 5 Please note that since mini-plate is on the underside of the main plate (see FIG. 5) when the invention is used, there must be a hole in the main plate to permit the ring that is attached to the mini-plate to come through so that the quick link can be attached.

The mini-plate serves to distribute the force on the cable when the plate is tilted upward as does the Y-shaped cable configuration. The main plate preferably has recesses or grooves 27 on its top surface 28 in which to lay the cables and thus align them between the points of connection with the mini-plate and the other points to which they are connected as shown in FIG. 3.

Plastic sleeves 29 can be used to place the cables therein to make handling of the cables easier to manage when aligning them in the grooves 27. Quick links 30 serve to connect the ends of the cables to their respective connecting points. Double (or two) quick links 44, 45 are used for connecting to the mini-plate as shown in FIG. 3. The purpose of the two quick links 44, 45 is to reduce the amount of tension at the connecting point of the mini-plate. This is accomplished by the two quick links that are connected to the ring that passes from the mini-plate 10 through the main plate 5. The cable passes through the second quick link. The puller cable 8 has its own quick link connecting to the quick link that the cable passes through. (See FIG. 3).

Figure 6:
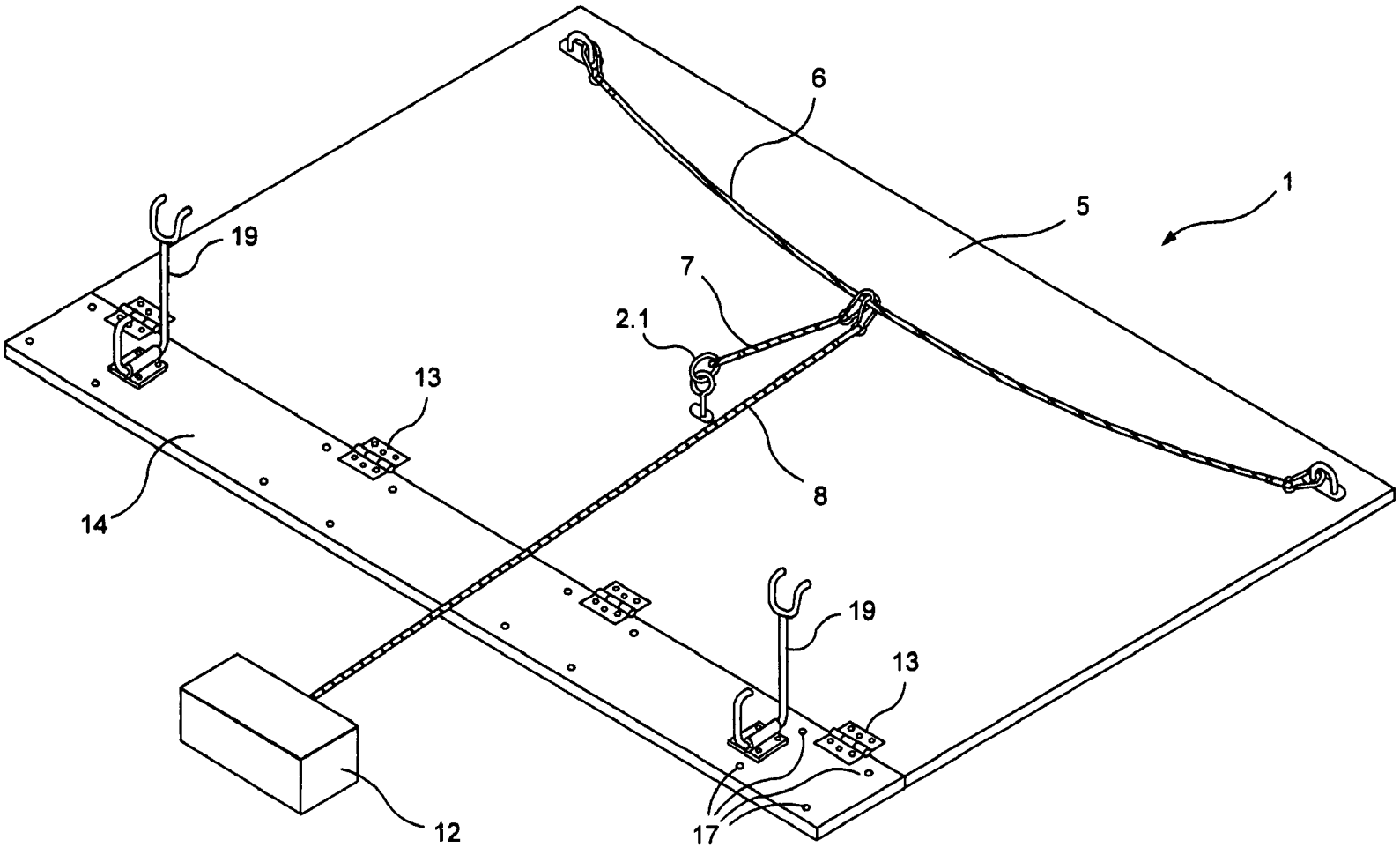
FIG. 6 is a perspective view of the invention in its initial resting position.
Figure 7:
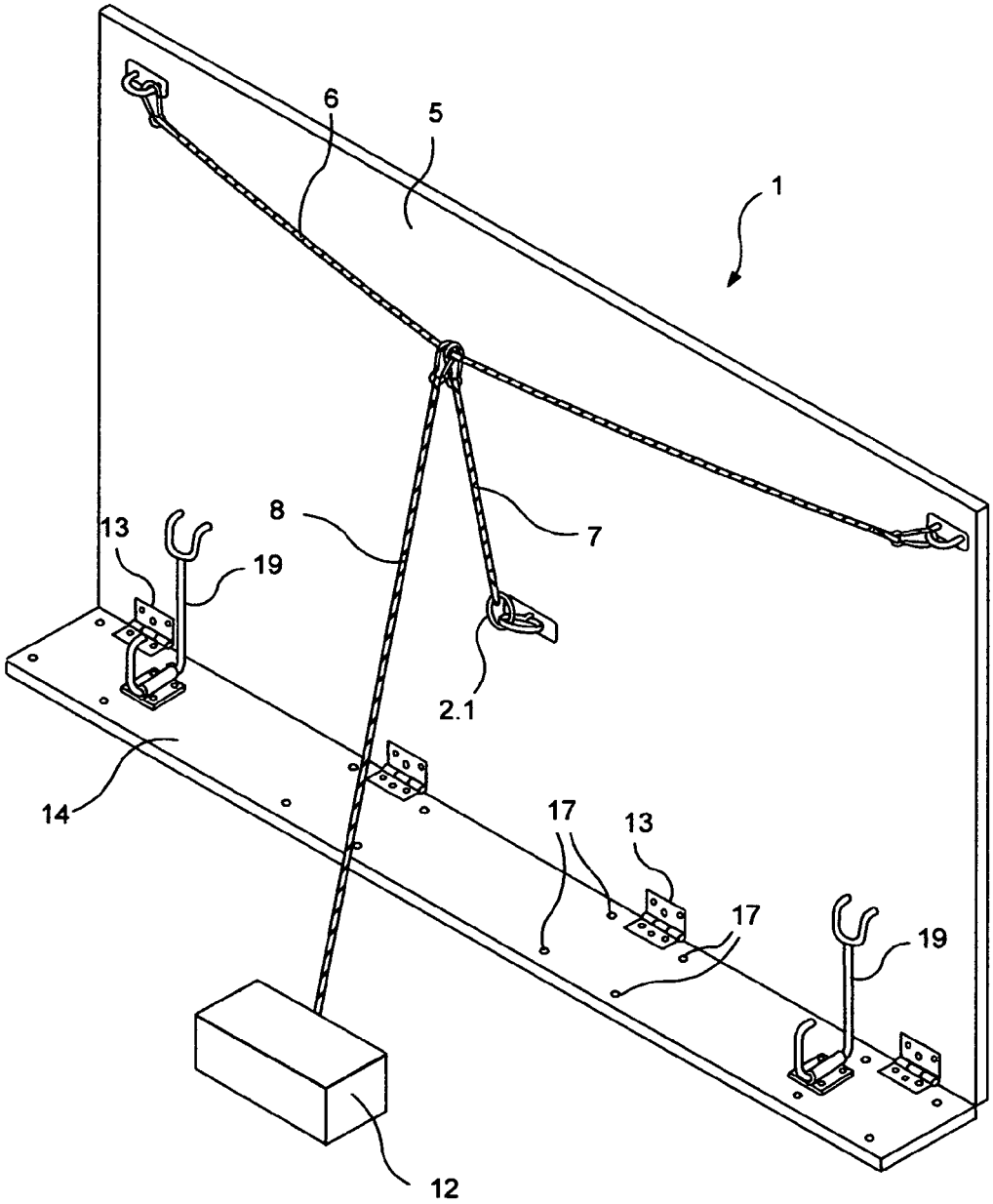
FIG. 7 is a perspective view of the invention in a tilted position.

FIGS. 6 and 7 show the main plate in its initial resting and tilting positions, respectively.

Figure 3:
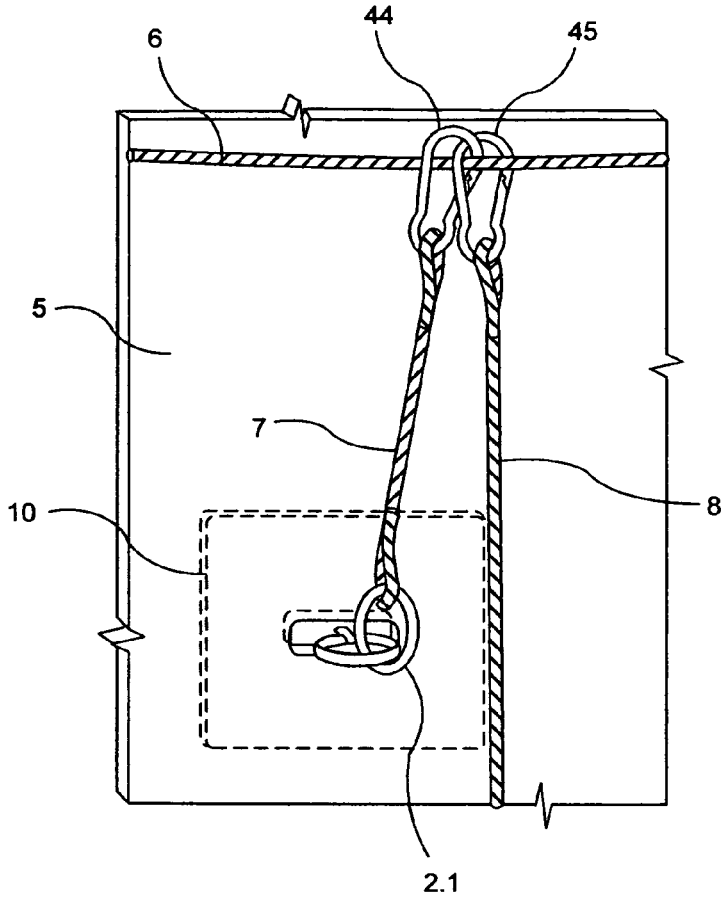
FIG. 3 illustrates how the upper, lower and puller cables are connected to the plates of the present invention of FIG. 1.
Figure 4:
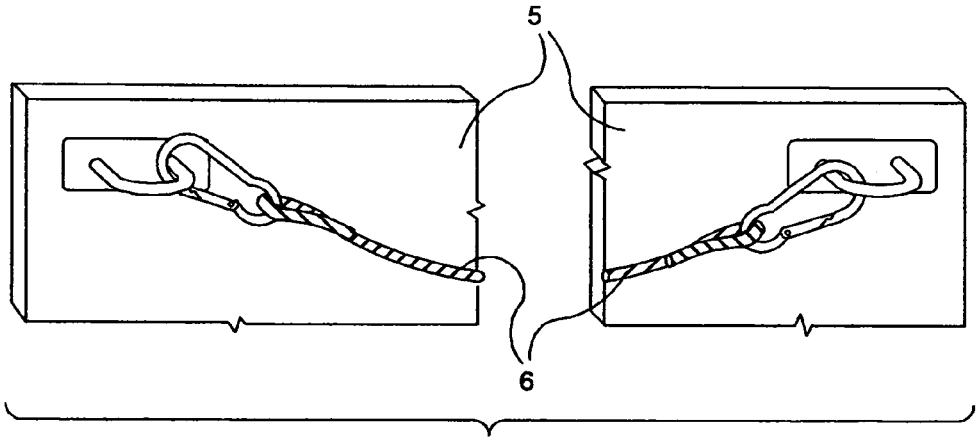
FIG. 4 illustrates how the corners of one side of the main plates—the side that is lifted upward—are fastened to the upper cable.

FIG. 3 is a sectional view showing the connections of the cables and the mini-plate and the sleeves housing the cables and the double rings.

The invention preferably includes the following components:

A main plate 5 and a mini-plate 10 that are placed on a ground surface structure such as a side walk, driveway or a runway at an airport.

Screws for fastening cables to corners of the main plate 5. Cables 6, 7 and 8 are required. The material for the base 14 can be plywood, metal or strong plastic. The base 14 is shaped as a flat part aligned to the plate which is preferably 1 foot by 22 feet.

Figure 5:
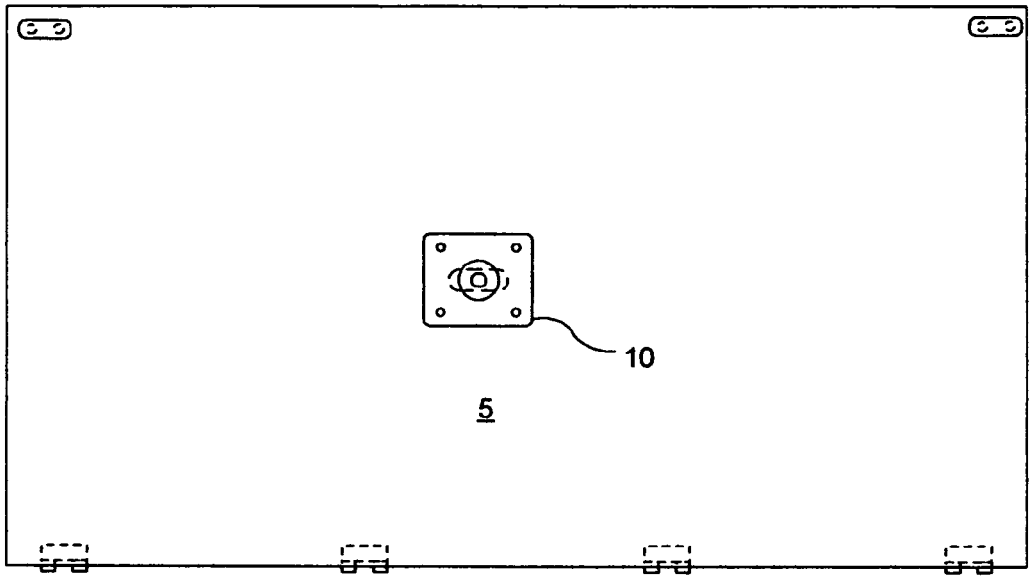
FIG. 5 is a view of the bottom of the main plate.

The mini plate 10 is placed underneath the main plate 5; the main plate 5 is preferably hollowed out in order for the bottom of the mini-plate bottom to be flush with the bottom of the main plate (see FIG. 5).

The stopper elements 19 are shown in FIGS. 5, 6 and 7 are lodged against the side of the main plate that the base is connected to. The stopper elements 19 can be of the type sold under the name HANG UP by Closetmaid as Vendor No. 3559 at Sears and Home Depot stores. It is understood that the invention is not limited to any particular stopper element and that known suitable substitutes may be used.

The two stoppers 19 are metallic pieces put on the right and left side bottom corners of the base 14. The base 14 is at the side of the plate. (See FIG. 5).

In one embodiment the first cable connecting to the two corners of the main plate 5 is 26 ft long The mini-plate 10 has a ring 2.1 through which a 2.5 ft. cable 7 passes through its two loopholes and secures to the first or upper cable 6 by a quick link. The base 14 is secured to the floor by fastening such as but not limited to Ram set nails. The hinges 13 connecting the base to the side of the main plate are secured to the main plate and the base by screws. These hinges 13 are preferably placed seven inches apart from each other. The u bolts 17 are secured to the corners of the main plate by four screws placed into the four holes in the u bolt and four corresponding holes drilled into each corner of the main plate where a u bolt is to be placed.

The dimensions of the main plate 5, mini-plate 10 and power requirements of the motor will vary in accordance with the amount of surface to be covered by the main plate. In certain environments such as an airport runway, it may be desirable to use several of these inventions arranged longitudinally along the runway area in sequence where a motor on a vehicle can be driven and connected to each one in turn so that each section or main plate is tilted separately until all the sections or main plates in the sequence are tilted and the snow removed from the runway. The invention can be assembled and disassembled fairly rapidly as required.

The main plate 5 can be preferably made of plywood, metal or strong plastic and for this embodiment has the dimensions of: 22'×10'×¾'. The mini-plate is preferably custom designed to be 2'×2'. The preferred ratio in size of the main plate to the mini plate is 55/1 based on square foot area of each plate. It is understood that this ratio may vary as desired.

The mini plate 10 can be of the size available for purchase at Home Depot previously described or can be made slightly larger by custom design. The motor can be capable of lifting 1500 pounds for a main plate sized at 22 ft by 10 ft. for this embodiment. Larger and more powerful motors will be required for larger sized main plate constructions.

It is understood that the lengths and widths of the cables used in the present invention may vary as required and the lengths and the widths of the cables described as this intended to be illustrative and the invention is not limited to the cable lengths and cable widths described herein. It is also understood that any suitable substitute for the cables may used in the invention.

It is understood that the invention is not limited to the specific size or sizes described for the components and the specific equipment described as the same is illustrative but not intended to be limiting of the invention.

While presently preferred embodiments have been described for purposes of the disclosure, numerous changes in the arrangement of method steps and apparatus parts can be made by those skilled in the art. Such changes are encompassed within the spirit of the invention as defined by the appended claims.

The invention claimed is:

1. An apparatus for removing snow form a ground surface, comprising:

a main plate disposed over a ground surface;

a mini-plate disposed underneath a center portion of said main plate, said mini-plate being co-planar with said main plate and substantially parallel to and spaced apart from ends of said main plate so as to reinforce said main plate when said mini plate and said main plate are lifted and tilted upward;

a motor disposed in a motor housing; and a set of cables connecting said main plate to said mini plate to said motor so that said motor is capable of pivoting said main plate upward said motor pulls said cables in order to lift and tilt one side of said main plate upward so that snow deposited on said main plate slides off of said main plate when it is tilted, said set of cables including three cables arranged in a Y-shaped configuration where a first of said three cables has a first end and a second end that are each connected to a respective corner of two corners of said one side of said main plate to facilitate lifting and tilting said main plate upward, said second of said three cables has a portion that passes through an opening in said center portion of said main plate and connects to said mini plate and a third cable of said three cables that is connected to said opening of said center portion of said main plate and is interconnected to said first and second cables at one end near to said mini-plate and at another end to said motor.

2. The apparatus according to claim 1 further comprising:

a base located and connected to a side opposite said side of said main plate that is lifted upward.

3. The main apparatus according to claim 2 wherein said base is connected to said side opposite by hinges.

4. The apparatus according to claim 1 wherein a pull cable is connected to said first and second cables by quick links.

5. The apparatus according to claim 1 further comprising at least one stopper element located at a side of said main plate so as to prevent said main plate from toppling over when said main plate is upwardly tilted.

6. The apparatus according to claim 1 wherein said cables are motor driven cables attached to sides of said main plate to at least lightly lift and tilt said main plate upward.

7. The method according to claim 1 wherein said cables are motor driven cables attached to sides of said main plate to at least lightly lift and tilt said main plate upward.

8. A method for removing snow from a ground surface, the steps comprising;

disposing a main plate over a ground surface;

disposing a mini-plate underneath a center portion of said main plate;

disposing a motor in a motor housing; and connecting a set of cables to said main plate and to said mini-plate and to said motor;

pulling said main plate by said motor for lifting and tilting said main plate upward so that snow deposited on said main plate slides off of said main plate when it is tilted; and arranging three cables of said set of cables in a Y-shaped configuration wherein a first of said three cables has a first end and a second end that are each connected to a respective corner of two corners of said one side of said main plate in order to at least slightly lift and tilt one side of said main plate upward and said second of said three cables has a portion that passes through an opening in said center portion of said main plate and connects to said mini plate by a third cable of said three cables that is connected to said opening of said center portion of said main plate and is connected at one end near to said mini-plate and at another end to said motor.

9. The method according to claim 8 further comprising:

locating and connecting a base to a side opposite said side of said main plate that is lifted upward.

10. The method according to claim 8 connecting said base to said side opposite by hinges.

11. The method according to claim 8 wherein said pull cable is connected to said second cable.

12. The method according to claim 8 further comprising preventing said main plate from toppling over when said main plate is upwardly tilted by at least one stopper element.

* * * * *